United States Patent [19]

Kettle

[11] 4,411,352

[45] Oct. 25, 1983

[54] RACETRACK ESCALATOR

[75] Inventor: John L. Kettle, Vernon, Conn.

[73] Assignee: Otis Elevator Company, Farmington, Conn.

[21] Appl. No.: 254,360

[22] Filed: Apr. 15, 1981

[51] Int. Cl.[3] ..... B66B 9/12

[52] U.S. Cl. ..... 198/328

[58] Field of Search ..... 198/326, 328, 800, 831

[56] References Cited

U.S. PATENT DOCUMENTS 2,677,451 5/1954 Normandeau ..... 198/328

*Primary Examiner*—James G. Smith

*Assistant Examiner*—Douglas D. Watts

*Attorney, Agent, or Firm*—Robert E. Greenstien

[57] ABSTRACT

A plurality of stairs are interconnected and propelled in a racetrack pattern between two floors of a building. The stairs are guided on rails and provide moving staircase sections for passengers to stand on for transport between the floors. The stairs move flatly in line with each other beneath the floor level in going from one of these staircase sections to the other. The stairs are interconnected and mounted on the rails in such a way that they can rotate relative to each other so that they can turn in going from one staircase section to the other.

2 Claims, 10 Drawing Figures

FIG. 1
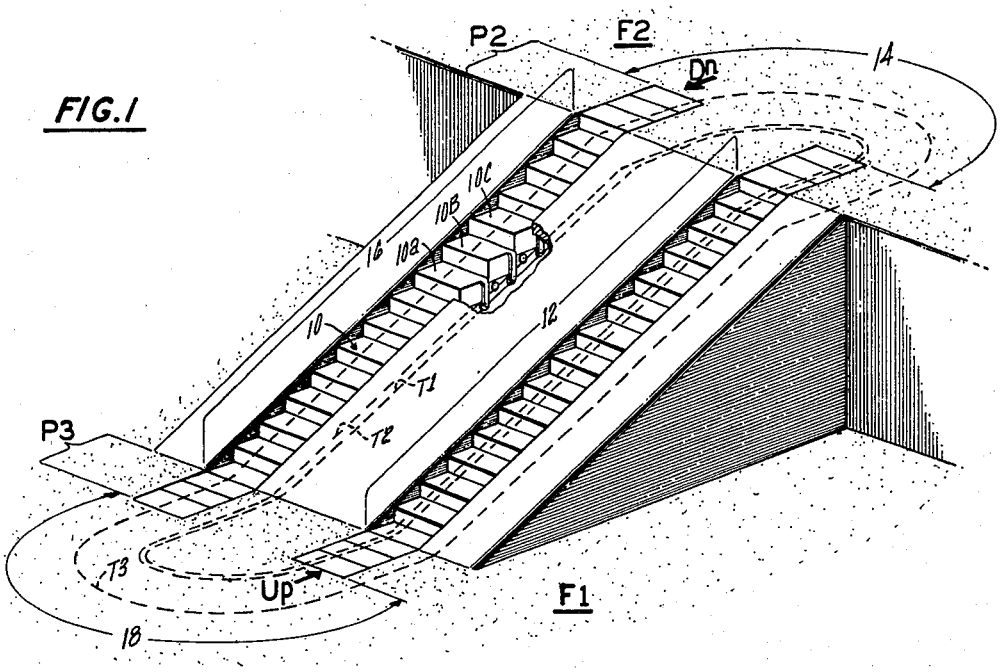
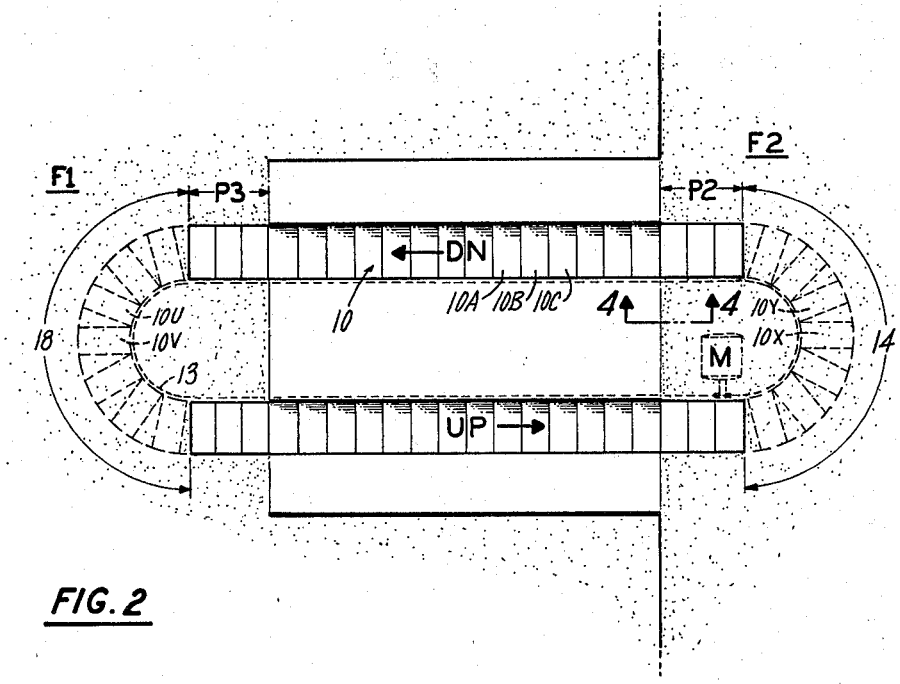
FIG. 2

FIG. 3
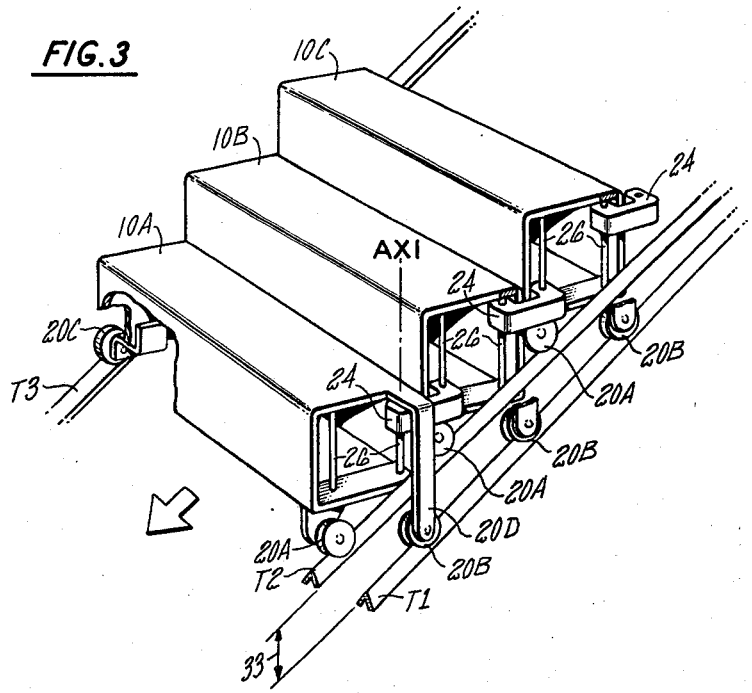
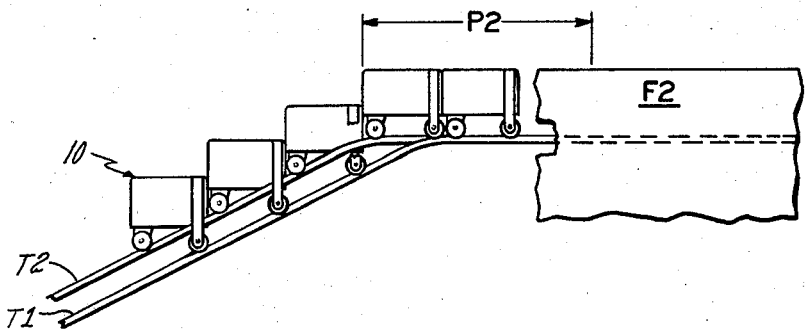
FIG. 4

FIG.5
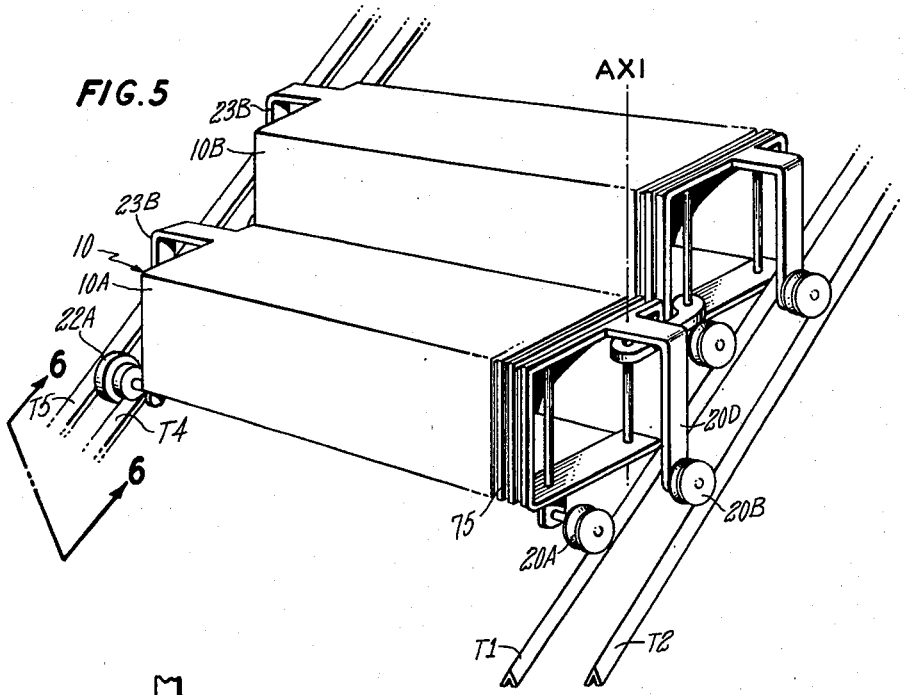
FIG.6
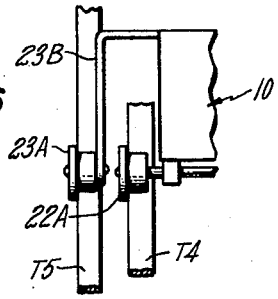
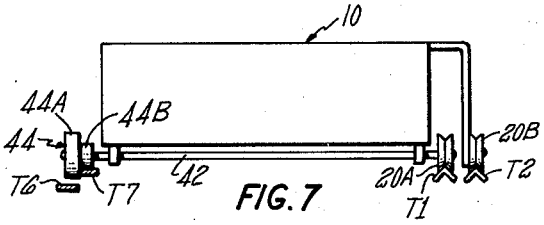
FIG.7
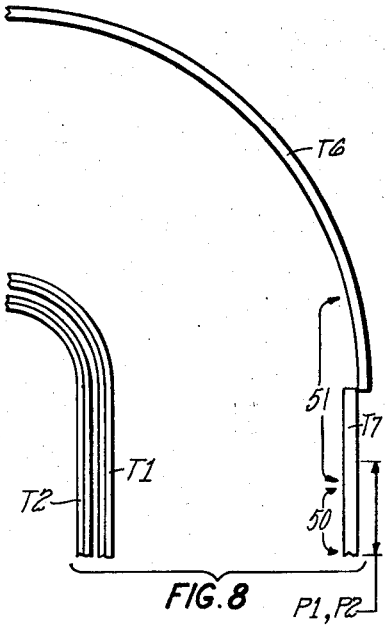
FIG.8
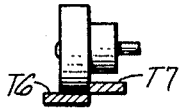
FIG.9
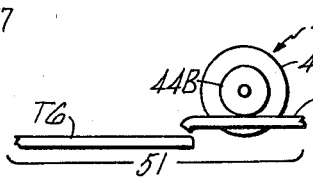
FIG.10

RACETRACK ESCALATOR

CROSS-REFERENCE TO RELATED APPLICATION

U.S. patent application Ser. No. 294,087, titled SPIRAL ESCALATOR, filed on Aug. 19, 1981 by John L. Kettle and also assigned to the assignee hereof, shows an escalator that has a spiral configuration.

TECHNICAL FIELD

This invention relates to conveyors for transporting passengers between floors, in particular, escalators.

BACKGROUND ART

Escalators have been widely used for a long time and their operation is well known. In general, an escalator consists of a plurality of interconnected stairs or steps which move in a closed loop, conveyor fashion between two floors, in effect, providing a moving staircase for transporting passengers. The drive mechanism typically consists of a chain which is driven by an electric motor. The stairs are suitably connected to the chain which pulls the stairs on tracks extending between the floors. The tracks control the position of the stairs to create the staircase and to permit the remaining stairs that return from a floor to be concealed below the staircase.

One appealing feature of escalators is that at the landings the stairs are perfectly level with the landing, permitting passengers to step on and step off of the moving stairs quite easily. In between the landing positions, the stairs assume the staircase arrangement, permiting the passengers to stand comfortably on horizontal surfaces as they are propelled at a steep incline between the floors.

Some newer arrangements do not use staircases but rather a long ramp containing a conveyor belt surface on which the passengers stand. These ramp systems are not really escalators since there are no stairs. Lacking stairs, the ramp incline of these systems must be less than the incline of the typical escalator so that the passengers may stand comfortably on the belt. A gentle incline takes up more space than a steep incline, and an escalator is therefore more "space effective" than the ramp system.

But, a negative characteristic of the conventional escalator and ramp systems alike is that only about 50% of the passenger carrying surface is actually used or available for transporting passengers at any time. The remaining 50%, that returning from the landing, is concealed beneath the staircase portions. This is not energy efficient: energy is lost which could be recaptured by counterbalancing up and down passenger loads by using the other 50% of the stairs.

DISCLOSURE OF INVENTION

According to the present invention, an escalator system is constructed of stairs which are moved in a racetrack pattern between two floors, one side of the pattern going up, the other going down. Each side provides a moving staircase for the passengers to stand on. Each stair is level with the floor as it leaves and approaches a floor, and each stair passes under the floor to go from one side of the pattern to the other. Adjacent stairs are coupled together so that they can elevate relative to each other to form the staircase sections and so that they can rotate or spread relative to each other to make the turn under the floor to move from one side of the pattern to the other.

The present invention thus provides an energy efficient escalator system characterized in that up and down loads counterbalance, a single motor drive can be used for both directions, almost all the stairs are available for passenger transport at all times, and building space is favorably utilized.

BRIEF DESCRIPTION OF DRAWINGS

FIG. 1 is a simplified perspective view of a racetrack escalator system according to the present invention for transporting passengers between two floors;

FIG. 2 is a plan view of the system;

FIG. 3 is a perspective view of several interconnected stairs in the system and a portion of the track arrangement on which they ride;

FIG. 4 is a simplified elevational view of the stairs in one portion of the system, as seen in direction 4—4 in FIG. 3, showing their relative configurations in staircase and floor level sections of the system;

FIG. 5 is a perspective view of one stair configuration according to the invention;

FIG. 6 is an elevational view of the roller and track arrangement shown in FIG. 5, as seen along the line 6—6 therein;

FIG. 7 is an elevation view of a second stair configuration according to another embodiment of the invention;

FIG. 8 is a plan view of rails or tracks for the stairs in FIG. 7;

FIG. 9 is an elevation view of the outboard stair supporting rollers shown in FIG. 7, showing their configuration on the rails in a straight section of the system; and FIG. 10 is an elevation view of the outboard tracks in FIG. 8 at the beginning of a curved section, showing the outboard roller on a straight track section.

BEST MODE FOR CARRYING OUT THE INVENTION

Referring to FIG. 1, a racetrack escalator system according to the present invention comprises a plurality of connected stairs 10 (stairs 10A, 10B, 10C being three such stairs). These stairs are propelled in a generally oval fashion (see FIG. 2) between two floors F1, F2, providing a closed loop train of stairs moving in a "racetrack" pattern. In passing through this pattern, each stair passes first through an ascending portion or section 12, through a first changeover portion 14, to a descending portion 16, and then through a second changeover portion 18 to the ascending portion 12. The two changeover portions are located below their respective floors, as FIG. 2 reveals. The stairs are interconnected and are driven in this racetrack pattern by a motor M driven chain, or cable 13. (These are shown functionally in FIG. 2, because similar drives are used in escalator systems and thus application of known drive concepts and designs can be applied to this system to move the stairs 10. For the same reasons, moving handrails and balustrading for the ascending and descending portions have not been shown.) As FIG. 3 shows, the stairs 10A, 10B, 10C ride on three tracks T1, T2, T3, and, as FIG. 1 shows, tracks T1 and T2, the main guidance tracks, follow the inner perimeter of the pattern; track T3, the idler track, follows the outer perimeter.

Defining the racetrack pattern, the tracks T1–T3 receive guide rollers 20A, 20B which are attached to each stair. Roller 20B is attached by an outrigger 20D. (The outrigger is shown on stair 10A only; it is cut away on 10B, 10C.) As FIG. 3 shows, track T2 is horizontally displaced (see arrow 33) from the track T1 to save space and simplify installation. These rollers and tracks should provide the required lateral stability to guide the stairs in the pattern. Thus, in this instance triangular tracks are used and each roller contains a triangular slot. Other roller and track configurations are possible, however, once these design techniques and criteria are understood. As explained later, a roller 20C is provided on the other side of each stair and rides on the rail 73, which is flat since this roller only provides load support and should be free to slide on the track T3 somewhat in the changeover portions where the stairs rotate (see FIG. 2).

FIG. 3 shows that the adjacent steps are only connected together along the inner perimeter (the path of tracks T1 and T2) of the pattern by means of a biaxis linkage coupling arrangement L1. This permits the steps to move vertically and rotationally with respect to each other about the generalized axis AX1. The reason for having this linkage is this: In order for the steps to make the turns in the two changeover sections 14 and 18, and yet stay together in the ascending and descending sections to provide the staircase pattern as shown in FIG. 1 on which the passengers may stand, the steps must be allowed to spread apart (as FIG. 2 shows) along the outer perimeter in the changeover sections 14 and 18. (In FIG. 2 the stairs in these sections are shown in dotted lines because they are underneath the floor; see FIG. 1.) The linkage L1 allows that to happen, it also allows the steps to assume the staircase pattern in the ascending and descending portions, but to "flatten out" so as to be perfectly flat with the floor surfaces in the changeover sections, so thay they can pass underneath the floors, and so that passengers may easily step on and off at the floors. FIG. 4 shows the stairs in transition from portion 14 to portion 16, in the zone P2. The same positioning occurs in zone P3, but in reverse in zone P3 in going from portion 14 to portion 18. In other words, FIG. 4 shows the stairs in either zone P2 or P3, in going from "staircase" to "flat".

The "biaxis linkage", linkage L1, comprises a connecting bar or link which is rotatably connected to a vertically extending bar or shaft 26 on the inner track edge of each stair. The link is free to move vertically or rotationally on each of these bars 26, thus interconnecting the adjacent stairs along the inner perimeter edge in such a way that each stair (10B or 10C for example) can rotate relative to each other about the axis AX1, move vertically with respect to each other along the axis, and pull the other along. In other words, the steps have controlled vertical and axial freedom, due to the linkage L1.

The position of the stairs in each of the portions 12, 14, 16 and 18 of the overall pattern is determined mainly by the incline of the tracks T1 and T2. As FIG. 4 demonstrates, in either an ascending or descending section the tracks T1 and T2 are inclined, giving rise to the staircase arrangement. The weight of the stairs pushes them together in the staircase sections, and the linkage maintains them in a vertical relationship as they move along. In the staircase portions the surfaces 32A and 32B are alternatively exposed between the ascending and descending portions. At the floor levels P2, P3 in FIG. 2, the tracks T1 and T2 are horizontal and in these portions the steps (e.g. 10D, 10E, and 10F) become coplanar, allowing them to pass underneath the floors, as illustrated in FIGS. 1 and 4.

The track T3 follows the tracks T1 and T2 and serves mainly to provide vertical stability (support) for the individual stairs along the outer perimeter of the pattern. The roller 20C on each stair should be allowed to track loosely (slide) on this track T3, to allow the stairs to separate along the outer perimeter, traced by the track T3 in the changeover sections 14 and 18. (In FIG. 2, see stairs 10X, 10Y in the section 14, and the stairs 10U and 10V in the section 18.)

Certain aspects of the system which have not been shown specifically may be incorporated into the design, as in existing escalators. For example, the stairs may be slotted or grooved (as in known escalators) on their upper surfaces 30 to provide a traction surface for the passengers. They also may be similarly slotted along their front and rear surfaces 32A, 32B in such a way that the slots on the upper surfaces 30 register with the slots on the front surfaces 32, enhancing the horizontal stability of the steps in the ascending and descending sections. Another variation may be in the location and attachment of the roller 20C. In FIG. 3, the roller 20C is mounted on a single bracket which is attached to the inside wall of the step. Using an alternative arrangement, however, the roller 20C could be similar to the bracket 20D on the outside of the step, in which case the rail T3 would have to be moved outward slightly.

Another alternative arrangement is shown in FIG. 5. There, two rollers 22A, 23A are placed along the outer perimeter portion of each step at positions corresponding respectively to tracks 22B and 23B on which they ride (see FIG. 6). The roller 23A is mounted on an outrigger 23B. The two tracks T4 and T5 (which can be flat since they only support load) side-by-side follow the pattern (mirror) of the guidance tracks T1 and T2, track T4 mirroring track T1, track T5 mirroring track T2. In this arrangement, as in the previous ones, the idler rollers 22A and 22B are flat so that they can slide on the tracks so that the stairs can rotate in the changeover sections.

FIG. 7 depicts another stair arrangement. Here, guidance rollers 20A, 20B move on the slotted tracks T1 and T2 again and one of the rollers 20A connects to a shaft 42 that passes lengthwise across the width of the stair to a roller 44 positioned in the middle of the stair edge. This idler assembly comprises two different diameter wheels or rollers 44A and 44B, and these ride exclusive of each other on two comparatively flat rails T6, T7, which follow the outermost perimeter of the racetrack pattern (just like the rails in T3 and T4 in FIG. 3). In straight sections (position 50 in Fig. 8) of this pattern, such as the staircase sections, the roller portion 44B rides on the flat track T7, as shown in FIG. 7. The rail T6 is set below and displaced horizontally outward from the rail T7, and when the stair comes to a turn (position 51 in FIG. 8), such as a changeover section at the floor level, the larger portion 44A rides onto the other rail T6 in the manner depicted in FIG. 9. The outer edge of the stair rides on this larger roller in the turns, and because the diameter of this roller is larger than the guidance roller to which it is connected, a differential turning force is applied in the direction of curvature, which aids the stair in smoothly negotiating the turn. The diameter of the larger roller is sized so that it covers the additional distance along the outer edge in the number of revolutions made by the guidance roller. Determining the diameter of the large roller requires computing the ratio between these two distances and then increasing the diameter of the guidance roller by that ratio. Level stairs in straight section 50 are obtained by positioning the rail 47 at a distance which is roughly the difference between the diameter of the larger roller and the guidance roller, as shown in FIG. 10, which shows also that the ends of the tracks may be bent down somewhat for providing smooth transition from one track to the other. The diameter of the smaller roller is roughly the same as the inner diameter of the guidance roller 20A because no turning force is required when rollers travel the same distance in straight sections. A significant feature of this arrangement is that interconnecting the idler rollers and the guidance rollers by a shaft provides improved stair directional stability, particularly in the staircase sections, because it connects each side of the stair to the opposite tracks, so to speak, which minimizes or eliminates entirely the skewing forces that can cause each stair to rotate or pivot when under load in ascending and descending sections of the pattern.

In still another variation (not shown), similar to the one in FIG. 5, the second guidance roller (e.g. roller 20B in FIG. 5) may also be attached by a shaft to another idler roller assembly like assembly 44. Comparing this arrangement to the one in FIG. 7, it provides even better stability in the staircase sections because it provides more traction surfaces, thus can be especially beneficial in the ascending and descending sections of the pattern.

While certain modifications, variations and substitutions in and to the described embodiment of the invention have been shown and explained, others may be apparent to one skilled in the art without departing from the true scope of the invention embodied therein.

I claim:

1. An escalator comprising a plurality of interconnected stairs which are propelled upon tracks by drive means, for transporting passengers between two floors, characterized in that:

the stairs are propelled between two floors in a closed loop racetrack-like pattern having an inner perimeter and an outer perimeter, a plurality of the stairs form moving staircase sections in the pattern for carrying passengers up and down between floors, the stairs pass underneath the floor when changing between those staircase sections and the stairs are substantially level with the floors just before and after passing underneath them;

a biaxis linkage couples each stair to its adjacent stair and is adapted to permit each stair to rotate and elevate relative to adjacent stairs along said inner perimeter about an axis located along the inner perimeter of the pattern and substantially normal to the horizontal direction of stair movement in the pattern, said linkage comprising a hinge bar and a pivot post; the pivot post is attached to the edge of each adjacent step joined by said coupling means, and extends in the direction of said axis which is substantially normal to the horizontal direction of stair movement, and the hinge bar is disposed to rotate on the post and also slide lengthwise along it;

at least three tracks support the stairs, two of these tracks follow the inner perimeter of the pattern and are inclined relative to the floors and vertically displaced relative to each other between floors to elevate adjacent stairs and are positioned at the floors to be substantially coplanar to the floors, and the third track follows the outer perimeter of the pattern and is positioned relative to the other two tracks;

each stair includes a first flat roller that rides on the third track and a pair of rollers, each roller riding on one of the other two tracks and registering with it;

the first flat roller is connected to one of the other rollers to provide a differential turning force as the stair moves around a curve in the pattern; and the first flat roller is rotationally coupled to one of the other two rollers, and has, axially disposed relative to each other, a first diameter portion for curved sections of the pattern, and a second portion with a smaller diameter substantially the same diameter as the roller to which the flat roller is coupled, for straight track sections of the pattern.

2. The escalator according to claim 1, characterized in that:

the third track has separate segments for curved and straight sections in the pattern which meet at switch points, and the segments for curved sections are set below those for straight sections by approximately the difference between the diameters of said first and second portions of the flat roller so that the stairs are level in the curved sections.

* * * * *